US007828083B2

(12) United States Patent
Sormunen et al.

(10) Patent No.: US 7,828,083 B2
(45) Date of Patent: Nov. 9, 2010

(54) METHOD OF CONTROLLING OPERATION OF ROCK DRILLING RIG, AND ROCK DRILLING RIG

(75) Inventors: Tapani Sormunen, Tampere (FI); Markus Salonen, Tampere (FI); Isto Virtanen, Lempäälä (FI)

(73) Assignee: Sandvik Mining and Construction Oy, Tampere (FI)

( * ) Notice: Subject to any disclaimer, the term of this patent is extended or adjusted under 35 U.S.C. 154(b) by 92 days.

(21) Appl. No.: 12/297,549

(22) Filed: Oct. 17, 2008

(65) Prior Publication Data

US 2009/0071715 A1 Mar. 19, 2009

(30) Foreign Application Priority Data

Apr. 21, 2006 (FI) ..... 20065252

(51) Int. Cl.
*E21B 21/08* (2006.01)
*E21B 44/00* (2006.01)

(52) U.S. Cl. ..... 175/57; 175/26; 175/38; 175/48

(58) Field of Classification Search ..... 175/38, 175/48, 26, 57
See application file for complete search history.

(56) References Cited

U.S. PATENT DOCUMENTS 4,188,624 A 2/1980 Hochsprung et al.
4,440,239 A * 4/1984 Evans ..... 175/5
4,703,664 A * 11/1987 Kirkpatrick et al. ..... 73/866.5
5,844,133 A * 12/1998 Goto et al. ..... 73/152.54
6,016,878 A * 1/2000 Jansson ..... 175/27
6,209,661 B1 * 4/2001 Muona ..... 175/25
6,637,522 B2 10/2003 Wilson et al.
6,820,702 B2 * 11/2004 Niedermayr et al. ..... 175/57
7,114,582 B2 * 10/2006 Eppink et al. ..... 175/61
2001/0013426 A1 * 8/2001 Wilson et al. ..... 175/48
2001/0037899 A1 11/2001 Bischel et al.
2001/0050186 A1 * 12/2001 Wilson et al. ..... 175/38
2002/0020561 A1 2/2002 Alft et al.
2004/0040746 A1 * 3/2004 Niedermayr et al. ..... 175/38
2004/0112645 A1 * 6/2004 Eppink et al. ..... 175/61
2009/0071715 A1 * 3/2009 Sormunen et al. ..... 175/38

FOREIGN PATENT DOCUMENTS

GB 2 024 434 1/1980
SU 1298372 3/1987
WO 2004/048747 6/2004
WO 2005/064111 7/2005

* cited by examiner

*Primary Examiner*—Jennifer H Gay
(74) *Attorney, Agent, or Firm*—Drinker Biddle & Reath LLP

(57) ABSTRACT

A method of controlling operation of a rock drilling rig, and a rock drilling rig. A rate of flow of a flushing medium of the rock drilling rig is determined, and the operation of the rock drilling rig is controlled on the basis of the determined rate of flow by influencing pressure of the flushing medium.

21 Claims, 1 Drawing Sheet

METHOD OF CONTROLLING OPERATION OF ROCK DRILLING RIG, AND ROCK DRILLING RIG

CROSS REFERENCE TO RELATED APPLICATIONS

This application is the National Stage of International Application No. PCT/FI2007/050199, filed Apr 18, 2007, and claims the benefit of Finnish Application No. 20065252, filed Apr 21, 2006.

BACKGROUND OF THE INVENTION

The invention relates to a method of controlling operation of a rock drilling rig, wherein a rate of flow of a flushing medium of the rock drilling rig is determined and the operation of the rock drilling rig is controlled on the basis of said rate of flow of the flushing medium.

The invention further relates to a rock drilling rig comprising means for feeding a flushing medium into a borehole for removing drill cuttings being produced during drilling out of the borehole, a measurement arrangement for determining a rate of flow of the flushing medium to be fed into the borehole, and at least one control unit for controlling operation of the rock drilling rig on the basis of the rate of flow of the flushing medium to be fed into the borehole.

Rock drilling rigs and rock drills arranged therein are used for rock drilling and excavation e.g. in underground mines, quarries, and earth construction sites. Typically, drilling simultaneously involves the use of four different functions or sectors, i.e. rotating a drill rod in a borehole being drilled, impacting on the rock by impacting on a drill bit by a percussion device via a shank and drill rods extending therefrom, as well as feeding the drill forward in the borehole being drilled, and flushing so as to remove drilling waste, i.e. drill cuttings, out of the borehole being drilled. In so-called rotary applications, in turn, only three sections are used since these applications do not include impacting on the rock by impacting on the shank by a percussion device. Furthermore, so-called DTH (Down-The-Hole) applications are used in which a percussion piston is located in a drill tube at the bottom of a hole and, rather than on the shank, impacts directly on the drill bit. Thus, the breakage of rock mainly takes place due to the influence of the impact while the purpose of rotating is mostly to ensure that buttons of a bit or other working parts of the drill bit located at an outmost end of the drill rods always impact on a new spot in the rock. The feeding enables a sufficient contact to be maintained between a bit and the rock.

Successful flushing, i.e. successful removal of drill cuttings out of the borehole being drilled, is very important as far as efficient drilling is concerned. If, during drilling, problems occur in the flushing, successful drilling quickly becomes endangered. U.S. Pat. No. 6,637,522 discloses a solution for controlling the operation of a rock drilling rig during drilling. In the solution disclosed in U.S. Pat. No. 6,637,522, a flushing flow is measured and a feed rate and/or rotational speed is controlled on the basis of the measured flushing flow. According to an embodiment of the publication, when the flushing flow decreases the feeding and/or rotation is stopped in order to avoid a drilling overload situation. WO 2005/064111, in turn, discloses a solution in which the aim is to control the flush power at least partly on the basis of the depth of a hole being drilled such that no greater power than that necessitated by the depth of the hole being drilled is used for the flushing. The purpose of the solution is thus to control the total power, which includes at least the impact power and/or rotational power and the flushing power, consumed by the drilling.

BRIEF DESCRIPTION OF THE INVENTION

An object of the present invention is to provide a novel solution for controlling the operation of a rock drilling rig on the basis of a rate of flow of a flushing medium.

The method according to the invention is characterized by determining the rate of flow of the flushing medium of the rock drilling rig on the basis of the rate of flow of the flushing medium flowing in a flushing channel system of the rock drilling rig, comparing the rate of flow of the flushing medium to a limit value set for the rate of flow of the flushing medium, and when the rate of flow of the flushing medium drops below said limit value, increasing pressure of the flushing medium.

The rock drilling rig according to the invention is characterized in that the measurement arrangement is configured to measure the rate of flow of the flushing medium flowing in a flushing channel system of the rock drilling rig, the control unit comprises means for comparing the rate of flow of the flushing medium to a limit value set for the rate of flow of the flushing medium, and in that when the rate of flow of the flushing medium drops below said limit value, the control unit is configured to increase pressure of the flushing medium.

The rate of flow of the flushing medium of the rock drilling rig is determined and the operation of the rock drilling rig is controlled on the basis of the rate of flow of said flushing medium. The operation of the rock drilling rig is controlled on the basis of the rate of flow of said flushing medium by influencing the pressure of the flushing medium. According to an embodiment, the operation of the rock drilling rig is controlled by increasing the pressure of the flushing medium.

By controlling the operation of the rock drilling rig by influencing the pressure of the flushing medium, the aim is to clear a clog being formed in a flushing channel system of the rock drilling rig without influencing the other sectors of drilling. When a clog is about to be formed in the flushing channel system, the rate of flow of the flushing medium in the flushing channel system decreases, but the aim is to clear the clog by increasing the pressure of the flushing medium and maintain the rate of flow of the flushing medium at least at a set value set therefor while at the same time normal drilling operation is maintained. Simultaneously, the functioning of the flushing is ensured and strain imposed on drilling equipment is reduced.

BRIEF DESCRIPTION OF THE DRAWINGS

Some embodiments of the invention are described in greater detail in the accompanying drawings, in which.

For the sake of clarity, the figures show some embodiments of the invention in a simplified manner. In the figures, like reference numbers identify like elements.

DETAILED DESCRIPTION OF SOME EMBODIMENTS OF THE INVENTION

Figure 1:
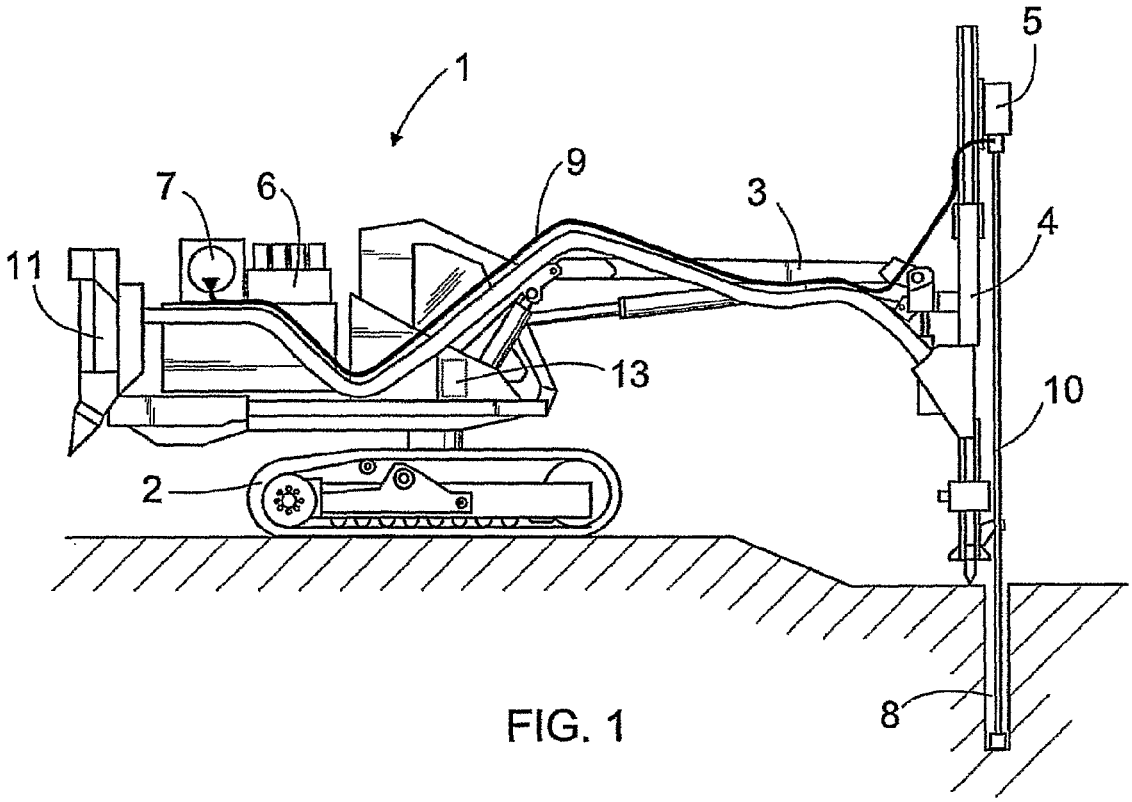
FIG. 1 is a schematic side view showing a rock drilling rig.

FIG. 1 schematically shows a structure of a rock drilling rig 1. The rock drilling rig 1 comprises a movable carrier 2 provided with a boom 3 whose free end is provided with a feed beam 4. Furthermore, the feed beam 4 is provided with a rock drill 5 which can be moved with respect to the feed beam 4. The rock drilling rig 1, including the devices connected thereto, are driven by power produced by a motor 6 arranged on the carrier 2, so that the rock drilling rig 1 is an independently moving and operating unit. Typically, the motor 6 is a combustion motor, e.g. a diesel motor. The rock drilling rig 1 according to FIG. 1 further comprises a compressor 7 driven by the motor 6 such that pressurized air generated by the compressor 7 is used for flushing a borehole 8 in order to remove drilling waste, i.e. drill cuttings, out of the borehole 8. In such a case, pressurized air, which is used as a flushing medium, is fed via a flushing channel system from the compressor 7 through a tool 10 of the rock drill into the borehole 8, whereby the pressurized air pushes the drill cuttings removed from the rock out of the borehole 8. The flushing channel system comprises a flushing line 9 passing from the compressor 7 to the drill 5 and, in the drill 5, flushing channels passing through a shank, a drill rod and a drill bit which, for the sake of clarity, are not shown in FIG. 1 but whose basic structure and principle are obvious to those skilled in the art. From the mouth of the borehole 8, the drill cuttings are sucked, via hoses included in a collection system, to a dust separator 11. The basic structure and operation of the rock drilling rig 1 and the rock drill 5 are known per se to one skilled in the art, so they are not discussed in further detail herein.

When the rock to be drilled is hard, the need to flush is quite small. In connection with soft rock, in turn, particularly when drilling with a large hole size, flushing is extremely necessary and the amount of drill cuttings removed from the rock is large, which means that there is a risk of the flushing channel system becoming clogged. In addition to the rock quality and hole size, the need to flush is affected e.g. by the type of drill rod and drill bit as well as the depth of the hole being drilled.

Figure 2:
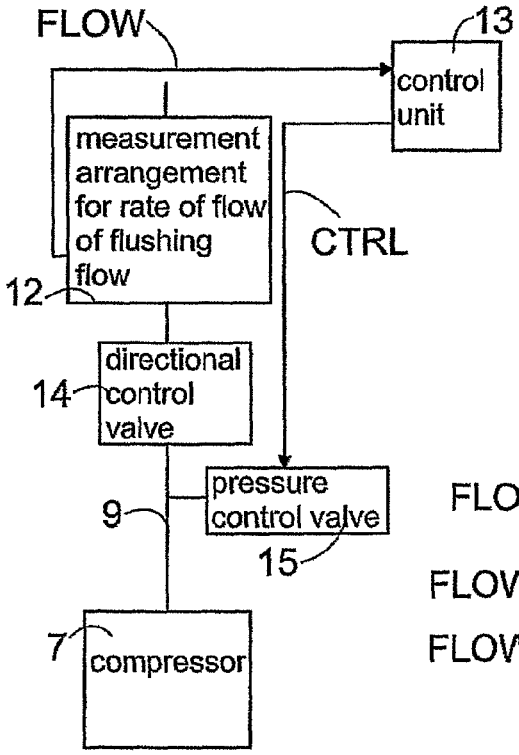
FIGS. 2 and 3 are schematic views showing a system for measuring a rate of flow of a flushing medium and for controlling pressure.
Figure 3:
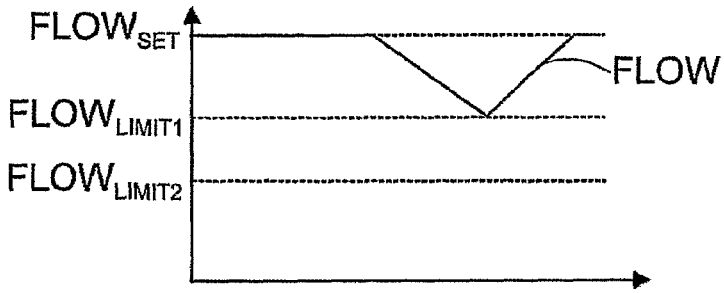

FIGS. 2 and 3 schematically show an embodiment implementing the solution. FIG. 2 shows a measurement arrangement 12 arranged in connection with a flushing line 9 of the rock drilling rig 1 for measuring a flow of rate FLOW of a flushing medium flowing in the flushing channel system, i.e. in the case shown in FIG. 1, for measuring a volume flow rate of pressurized air. Instead of the flushing line 9, said measurement arrangement may also be placed differently in the flushing channel system. The measurement arrangement 12 for the rate of flow of a flushing medium may comprise e.g. a measuring device based on a Venturi tube for measuring a pressure difference left over the Venturi tube in a manner known per se. However, the measurement arrangement 12 may be implemented in various different ways such that in one way or another it is possible to measure the rate of flow FLOW of the flushing medium flowing in the flushing channel system or quantities proportional thereto. Instead of using a Venturi tube, a difference between pressure measured at any two different points in the flushing channel system may be used for measuring the rate of flow of the flushing medium. Thus, the rate of flow of the flushing medium may be determined e.g. on the basis of a difference between pressures acting on opposite sides of a directional control valve or on the basis of a difference between pressures acting at extreme ends of the flushing channel system. Typically, the unit used for the rate of flow of the flushing medium is $m^3$/min. Information FLOW describing the rate of flow of the flushing medium is transferred to a control unit 13, which may be a control unit controlling flushing only or a control unit controlling the operation of the entire rock drilling rig 1. Furthermore, the rate of flow of the flushing medium may be presented to a user graphically or as a numerical value in a user interface of the rock drilling rig 1.

The rate of flow FLOW of the flushing medium measured from the flushing channel system is compared to a first limit value $FLOW_{LIMIT1}$ set for the rate of flow of the flushing medium. When the rate of flow FLOW of the flushing medium passing in the flushing channel system drops below said first limit value $FLOW_{LIMIT1}$ of the rate of flow of the flushing medium, it is interpreted that a clog is being formed in the flushing channel system. In such a case, the control unit 13 sends a control message CTRL, in the case shown in FIG. 2, to a pressure control valve 15 included in the flushing channel system and located between the compressor 7 and the directional control valve 14 in order to increase a control value of the valve to increase the pressure p_FLOW of the flushing medium flowing in the flushing channel system and thus to feed the flushing medium at a higher pressure so as to clear any clog possibly being formed in the flushing channel system. The pressure control valve 15 is used for setting a desired pressure of the compressor 7. The pressure control valve 15 may be e.g. a steplessly adjustable electrically controlled valve or it may consist of several pressure control valves that have been in advance set to a different pressure value. Naturally, a clog in the flushing channel system by itself increases the pressure on the flushing medium but, according to the solution, the pressure of the flushing medium is increased to a level which is clearly higher than a level corresponding to such a pressure increase. The pressure p_FLOW of the flushing medium may be increased e.g. such that the rate of flow FLOW of the flushing medium increases, as shown in FIG. 3, to a level corresponding to an original set value $FLOW_{SET}$ of the rate of flow of the flushing medium or to a maximum permissible value $p_FLOW_{MAX}$ of the pressure of the flushing medium. The user interface of the rock drilling rig 1 may, e.g. graphically or as numerical values, continuously show the real, instantaneous rate of flow of the flushing medium as well as the aforementioned limit values that enable the user to monitor how the drilling progresses. In addition, the user interface may be provided with a control element or the like to enable the user to influence the aforementioned limit values at any time.

According to the solution, the aim is thus to maintain the flushing flow at least at the set value in order to ensure the functioning of the flushing. When a clog is about to be formed in the flushing channel system, i.e. in practice most typically in the flushing channels of the drill bit, the rate of flow of the flushing medium in the flushing channel system decreases, in which case the flushing channel system is kept open by increasing the pressure of the flushing medium. The aim is thus to return the rate of flow FLOW of the flushing medium at least to the set value $FLOW_{SET}$ set therefor, thus preventing the flushing channel system from being clogged while at the same time maintaining normal drilling operation. The manner according to the solution thus in a simple manner enables a flushing apparatus to be prevented from being clogged during drilling.

Instead of the pressure control valve 15, the pressure of the flushing medium may also be increased by changing the rotational speed of rotors of the compressor 7. In such a case, e.g. the control unit 13 sends the compressor 7 a control message for increasing the rotational speed of the rotors, which causes an increase in the volume flow of air and thus also an increase in the pressure.

Furthermore, the pressure of the flushing medium may be controlled by adjusting air intake of the compressor. By connecting e.g. a position servo to a spool moving a plate of a suction valve, the output pressure of the compressor may be influenced by restricting or opening the suction valve.

Rather than increasing the pressure of the flushing medium only after the rate of flow FLOW of the flushing medium drops below the first limit value $FLOW_{LIMIT1}$, the pressure may be increased immediately when the rate of flow of the flushing medium starts decreasing. In each case, the pressure of the flushing medium may be increased either stepwise or proportionally to the decrease in the rate of flow of the flushing medium.

If increasing the flushing pressure p_FLOW of the flushing medium does not succeed in returning the rate of flow FLOW of the flushing medium to normal but the rate of flow of the flushing medium keeps decreasing, a second limit value $FLOW_{LIMIT2}$ of the rate of flow FLOW of the flushing medium may be introduced in the apparatus, so that when the rate of flow FLOW of the flushing medium drops below this second limit value $FLOW_{LIMIT2}$, the feed function of the rock drilling rig 1 is stopped, controlled by the control unit 13, in which case drilling no longer progresses and no drill cuttings are produced. When necessary, controlled by the control unit 13, the drilling equipment may also be pulled backwards in the borehole 8 in order to return the flow of the flushing medium.

Instead of or in addition to the rate of flow FLOW of the flushing medium, it is also possible to monitor a rate of change dFLOW of the rate of flow FLOW of the flushing medium, which enables any currently occurring clog of the flushing, typically in practice the drill bit, to be observed very quickly on the basis of an abrupt change in the rate of flow FLOW of the flushing medium already before the measured rate of flow FLOW drops below the first limit value $FLOW_{LIMIT1}$. The rate of change dFLOW of the rate of flow FLOW of the flushing medium can be determined e.g. at the control unit 13 e.g. on the basis of a difference in two or more successive measurements of the rate of flow FLOW of the flushing medium. This value of the rate of change dFLOW is compared to a first limit value $dFLOW_{LIMIT1}$ set for the rate of change of the rate of flow of the flushing medium. When the rate of change dFLOW of the rate of flow FLOW exceeds the first limit value $dFLOW_{LIMIT1}$, it is interpreted that a clog is being formed in the flushing, in which case the control unit 13 controls the pressure valve 15 in the flushing channel system to increase the pressure p_FLOW.

In a manner similar to that used in connection with the rate of flow of the flushing medium, a second limit value $dFLOW_{LIMIT2}$ may also be determined for the rate of change of the rate of flow of the flushing medium, such that when the rate of change exceeds said limit value, the feed function of the rock drilling rig is stopped, controlled by the control unit 13, in which case the drilling no longer progresses and no drill cuttings are produced. Also in this case, when necessary, the drilling equipment, also controlled by the control unit 13, may be pulled backwards in the borehole 8 in order to return the flow of the flushing medium.

The control unit 13 may also further comprise means, such as a comparison element, for comparing the rate of flow FLOW of the flushing medium to a corresponding set value $FLOW_{SET}$. In such a case, after the clog has been cleared and after the rate of flow FLOW of the flushing medium has returned to a corresponding set value $FLOW_{SET}$, the control unit 13 may be controlled to return the pressure p_FLOW of the flushing medium to a set value $p_FLOW_{SET}$ of the pressure of the flushing medium acting during a normal state of the drilling.

In order to enhance the return of the flow of the flushing medium, an arrangement may also be used wherein when the feed of the drilling is interrupted, or simultaneously when the drilling equipment is being pulled backwards in the hole being drilled, a percussion device is used for impacting on the drilling equipment so as to produce vibration in the drilling equipment. The purpose of such vibration is to enhance loosening of drill cuttings stuck to the flushing channel system therefrom. The percussion device is thus used for impacting on the shank of the rock drill. In order to prevent too long a distance from being provided between the shank and the percussion device during the backwards pulling of the drilling equipment, which prevents the percussion device from impacting on the shank efficiently, a pulling element, such as a pull piston, may be arranged in connection with the shank. The pulling element keeps the distance between the percussion device and the shank constantly optimal such that the percussion device is able to efficiently impact on the shank and produce considerable vibration in the drilling equipment in order to enhance removal of the drill cuttings.

The rock drilling rig 1 may thus comprise one or more control units 13 such that the control unit 13 may control the operation of the entire rock drilling rig or each sector of drilling may be provided with a control unit of its own. The control unit may be e.g. a device comprising a microprocessor and/or a signal processor and possibly memory capacity external thereto in order to execute necessary calculation and comparison procedures by software contained therein. The control unit may also be a device comprising various electronic circuits only and having necessary elements for producing a difference between two or more quantities e.g. for determining the rate of change of the rate of flow of said flushing medium and for comparing the determined rate of flow or the rate of change of the rate of flow to the corresponding limit values that may be set by the user of the rock drilling rig 1. The general structure and operating principle of such control units and devices are known per se to those skilled in the art.

Knowledge of the rate of flow FLOW of the flushing flow may also be applied to automatic calibration of flush monitoring. A main target in the calibration is to acknowledge losses caused by the drilling equipment, i.e. the shank, drill rod and drill bit, i.e. to determine the rate of flow of the flushing medium through the drilling equipment when it is free from drilling, i.e. when the flushing channel system is completely open. In the calibration, a measurement result provided by the measurement arrangement 12 measuring the rate of flow of the flushing medium is determined both with a real zero flow, i.e. when no flushing flow is provided at all, and with a real full-scale flushing flow. However, in addition to these two measurement points, other measurement points may also be used in calibration. Calibration measurement results thus obtained can be transferred directly to a unit implementing flush monitoring to take into account small operational differences that due to e.g. production tolerances occur in devices included in the measurement arrangement measuring the rate of flow of the flushing flow. Such automatic calibration may be utilized in calibration carried out both in factory calibration and at the drilling site. In factory calibration, changes caused by different drilling equipment can be taken into account in the measurement results of the rate of flow of the flushing medium. Calibration at the drilling site, in turn, may be carried out whenever desired in order to compensate for drift occurring in measurement devices over time or in order to take into account possible effects caused by drilling conditions on the drilling process or changes in the measurement of the rate of flow of the flushing medium caused by changes in the drilling equipment, e.g. replacement of a drill bit.

In the figures, the solution is shown in connection with a rock drilling rig in which pressurized air produced by a compressor 7 or another device appropriate for producing pressurized air is used as the flushing medium. However, the solution may also be utilized in rock drilling rigs in which pressure fluid, which may be e.g. water, a mixture of water and air or a mixture of water and a chemical, is used as the flushing medium. When pressure fluid is used as the flushing medium, the compressor is replaced by a pump or the like which, by the power produced by a motor 6 directly or indirectly, feeds the flushing medium via a flushing channel system to a rock drill 5 and further, through a tool 10 of the rock drill 5 into a borehole 8, whereby said flushing medium pushes drill cuttings removed from the rock out of the borehole 8. In such a case, the rock drilling rig then naturally also has to be provided with a special reservoir or connection for delivery of the flushing fluid to the rock drilling rig. The pressure of the flushing medium may then be increased in a manner substantially similar to that shown in connection with the above example, taking, however, into account differences that are obvious to one skilled in the art in the operation of the compressor and the pump as well as changes in the apparatus caused by replacing air by fluid as the flushing medium.

In some cases the features disclosed in the present application may be used as such, irrespective of other features. On the other hand, when necessary the features disclosed in the present application may be combined so as to produce different combinations.

The drawings and the related description are only intended to illustrate the idea of the invention. In its details the invention may vary within the scope of the claims.

The invention claimed is:

1. A method of controlling operation of a rock drilling rig the method comprising:

determining the rate of flow of the flushing medium of the rock drilling rig on the basis of the rate of flow of the flushing medium flowing in a flushing channel system of the rock drilling rig;

comparing the rate of flow of the flushing medium to a rate of flow limit value set for the rate of flow of the flushing medium; and when the rate of flow of the flushing medium drops below said limit value, increasing pressure of the flushing medium, wherein the pressure of the flushing medium is increased by increasing a control value of a pressure control valve included in the flushing system to a value above a set value of the pressure of the flushing medium acting during a normal state of the drilling, and wherein when the rate of flow has returned to a corresponding set value, the pressure control valve is controlled to return the pressure of the flushing medium to the set value of the pressure of the flushing medium acting during the normal state of the drilling.

2. A method as claimed in claim 1, further comprising:

determining a rate of change of the rate of flow of the flushing medium;

comparing the rate of change of the rate of flow of the flushing medium to a corresponding first rate of change limit value for the rate of change of the rate of flow; and when the rate of change of the rate of flow of the flushing medium exceeds said first rate of change limit value, increasing the pressure of the flushing medium.

3. A method as claimed in claim 2, further comprising comparing the rate of change of the rate of flow of the flushing medium to a corresponding second rate of change limit value, and when the rate of change of the rate of flow of the flushing medium exceeds said second rate of change limit value, stopping the feed function of the rock drilling rig.

4. A method as claimed in claim 3 further comprising pulling drilling equipment of the rock drilling rig backwards in a hole being drilled.

5. A method as claimed in claim 1 wherein the pressure of the flushing medium is increased such that the rate of flow of the flushing medium increases to a value corresponding to a set value of the rate of flow of the flushing medium.

6. A method as claimed in, claim 1, wherein the pressure of the flushing medium is increased to a maximum permissible value set therefor.

7. A method as claimed in claim 1, further comprising comparing the rate of flow of the flushing medium to a second rate of flow limit value set for the rate of flow of the flushing medium, and when the rate of flow of the flushing medium drops below said second rate of flow limit value, stopping a feed function of the rock drilling rig.

8. A method as claimed in claim 7 further comprising pulling drilling equipment of the rock drilling rig backwards in a hole being drilled.

9. A method as claimed in claim 1, further comprising comparing the rate of flow of the flushing medium to a set value set therefor, and after the rate of flow of the flushing medium has returned to a corresponding set value, returning the pressure of the flushing medium to a set value of the pressure of the flushing medium acting during a normal state of the drilling.

10. A method as claimed in claim 1, wherein the flushing medium is pressurized air, pressure fluid, or a mixture thereof.

11. A rock drilling rig comprising:

a device for feeding a flushing medium into a borehole for removing drill cuttings being produced during drilling out of the borehole;

a measurement arrangement for determining a rate of flow of the flushing medium to be fed into the borehole by measuring the rate of flow of the flushing medium flowing in a flushing channel system of the rock drilling rig; and a control unit is configured to compare the measured rate of flow of the flushing medium to a limit value set for the rate of flow of the flushing medium, wherein the control unit being configured to increase pressure of the flushing medium when the rate of flow of the flushing medium drops below said limit value, wherein the pressure of the flushing medium is increased by increasing a control value of a pressure control valve included in the flushing system to a value above a set value of the pressure of the flushing medium acting during a normal state of the drilling, and wherein when the rate of flow has returned to a corresponding set value, the pressure control valve is controlled to return the pressure of the flushing medium to the set value of the pressure of the flushing medium acting during the normal state of the drilling.

12. A rock drilling rig as claimed in claim 11, wherein the rock drilling rig is configured to influence the pressure of the flushing medium, controlled by the control unit.

13. A rock drilling rig as claimed in claim 11 wherein the control unit is further configured to:

determine a rate of change of the rate of flow of the flushing medium;

compare the rate of change of the rate of flow of the flushing medium to a first limit value set for the rate of change of the rate of flow of the flushing medium; and when the rate of change of the rate of flow of the flushing medium exceeds said first limit value, the control unit is configured to increase the pressure of the flushing medium.

14. A rock drilling rig as claimed in claim 11, wherein the control unit is configured to increase the pressure of the flushing medium such that the rate of flow of the flushing medium is increased to a value corresponding to a set value of the rate of flow of the flushing medium.

15. A rock drilling rig as claimed in claim 11, wherein the control unit is configured to increase the pressure of the flushing medium to a maximum permissible value set therefor.

16. A rock drilling rig as claimed in claim 11, wherein the control unit is further configured to compare the rate of flow of the flushing medium to a corresponding second limit value, and when the rate of flow of the flushing medium drops below said second limit value, the control unit is configured to stop a feed function of the rock drilling rig.

17. A rock drilling rig as claimed in claim 16, wherein the control unit is configured to control drilling equipment of the rock drilling rig to be pulled backwards in the borehole being drilled.

18. A rock drilling rig as claimed in claim 11, wherein the control unit is further configured to compare the rate of change of the rate of flow of the flushing medium to a corresponding second limit value, and when the rate of change of the rate of flow of the flushing medium exceeds said second limit value, the control unit is configured to stop the feed function of the rock drilling rig.

19. A rock drilling rig as claimed in claim 18, wherein the control unit is configured to control drilling equipment of the rock drilling rig to be pulled backwards in the borehole being drilled.

20. A rock drilling rig as claimed in claim 11, wherein the control unit is further configured to compare the rate of flow of the flushing medium to a set value set therefor and that after the rate of flow of the flushing medium has returned to a corresponding set value, the control unit is configured to return the pressure of the flushing medium to a set value of the pressure of the flushing medium acting during a normal state of the drilling.

21. A rock drilling rig as claimed in claim 11, wherein the flushing medium is pressurized air, pressure fluid, or a mixture thereof.

* * * * *